US006162595A

United States Patent [19]

Chen

[11] Patent Number: 6,162,595

[45] Date of Patent: Dec. 19, 2000

[54] REVERSAL PHOTOGRAPHIC ELEMENTS COMPRISING AN ADDITIONAL LAYER CONTAINING AN IMAGING EMULSION AND A NON-IMAGING EMULSION

[75] Inventor: Keath T. Chen, Rochester, N.Y.

[73] Assignee: Eastman Kodak Company, Rochester, N.Y.

[21] Appl. No.: 09/448,210

[22] Filed: Nov. 23, 1999

[51] Int. Cl.[7] ..... G03C 1/46; G03C 1/494; G03C 5/50; G03C 7/18; G03C 7/26

[52] U.S. Cl. ..... 430/504; 430/506; 430/509; 430/407; 430/379; 430/523; 430/539; 430/568

[58] Field of Search ..... 430/504, 506, 430/509, 379, 407, 523, 539, 568

[56] References Cited

U.S. PATENT DOCUMENTS

| | | | |
|---|---|---|---|
| 4,082,553 | 4/1978 | Groet | 430/505 |
| 4,400,463 | 8/1983 | Maskasky | 430/434 |
| 4,433,048 | 2/1984 | Solberg et al. | 430/434 |
| 4,434,226 | 2/1984 | Wilgus et al. | 430/567 |
| 4,435,501 | 3/1984 | Maskasky | 430/434 |
| 4,439,520 | 3/1984 | Kofron et al. | 430/434 |
| 4,554,245 | 11/1985 | Hayashi et al. | 430/567 |
| 4,614,707 | 9/1986 | Fujita et al. | 430/379 |
| 4,656,122 | 4/1987 | Sowinski et al. | 430/505 |
| 4,752,558 | 6/1988 | Shimura et al. | 430/505 |
| 5,176,990 | 1/1993 | Kim | 430/569 |
| 5,262,287 | 11/1993 | Deguchi et al. | 430/504 |
| 5,391,468 | 2/1995 | Cohen et al. | 430/503 |
| 5,552,265 | 9/1996 | Bredoux et al. | 430/504 |
| 5,691,124 | 11/1997 | Kim et al. | 430/509 |
| 5,698,383 | 12/1997 | Pugh et al. | 430/509 |
| 5,830,628 | 11/1998 | Borst et al. | 430/506 |
| 5,932,401 | 8/1999 | Chen | 430/504 |

FOREIGN PATENT DOCUMENTS

| | | |
|---|---|---|
| 442 323 | 8/1991 | European Pat. Off. . |
| 34 02 840 | 7/1993 | Germany . |
| 195 26 470 | 1/1997 | Germany . |
| 63-263034 | 9/1988 | Japan . |
| 1 201 110 | 8/1970 | United Kingdom . |

OTHER PUBLICATIONS

Research Disclosure, Jan. 1993, No. 22534, titled "Sensitized High Aspect Ratio Silver Halide Emulsions And Photographic Elements", pp. 20–58.

*Primary Examiner*—Richard L. Schilling
*Attorney, Agent, or Firm*—Andrew J. Anderson

[57] ABSTRACT

Photographic elements capable of forming a reversal image are disclosed comprising a support and, coated on said support, at least one image recording emulsion layer comprised of a dispensing medium and radiation sensitive silver halide grains and at least one substantially non-image forming layer. In one embodiment, the substantially non-image forming layer comprises: a) a light sensitive silver halide imaging emulsion which is less than 10 percent of the mass of the total imaging emulsion in the element; b) a first non-image forming silver salt emulsion having an average grain size less than 0.15 μm; and c) a second non-image forming silver salt emulsion comprising iodide having an average grain size greater than that of the first non-image forming emulsion. In a second embodiment, the substantially non-image forming layer comprises: a) a light sensitive silver halide imaging emulsion which is less than 10 percent of the mass of the total imaging emulsion in the element; and b) a polydisperse non-image forming silver salt emulsion comprising iodide and having an average grain size less than 0.15 μm and a coefficient of variation of at least 50%. In the substantially non-image forming layer of the invention, the surface area ratio of the grains of the non-image forming emulsion(s) to the grains of the imaging emulsion is more than 2:1. The combination of the imaging and non-imaging emulsions in the special substantially non-image forming layer gives an increase in interlayer interimage effects, increasing the color of the film.

26 Claims, 1 Drawing Sheet

REVERSAL PHOTOGRAPHIC ELEMENTS COMPRISING AN ADDITIONAL LAYER CONTAINING AN IMAGING EMULSION AND A NON-IMAGING EMULSION

FIELD OF THE INVENTION

This invention relates to improved photographic elements adapted for producing reversal images. More specifically, this invention relates to reversal silver halide photographic elements containing an overcoat or intercoat layer comprising an imaging emulsion and a blend of non-image forming emulsions or a polydisperse non-image forming emulsion.

BACKGROUND OF THE INVENTION

The term "silver haloiodide" is employed in its art recognized usage to designate silver halide grains containing silver ions in combination with iodide ions and at least one of chloride and bromide ions. The term "reversal photographic element" designates a photographic element which produces a photographic image for viewing by being imagewise exposed and developed with a first non-chromogenic "black and white" developing agent to produce a negative of the image to be viewed, followed by uniform exposure and/or fogging of residual silver halide and processing to produce a second, viewable image. Such reversal elements are typically sold packaged with instructions to process using a color reversal process such as the Kodak E-6 process as described in The British Journal of Photography Annual of 1988, page 194. Color slides, such as those produced from Kodachrome® and Ektachrome® films, constitute a popular example of reversal photographic elements. In the overwhelming majority of applications the first image is negative and the second image is positive. Groet U.S. Pat. No. 4,082,553 illustrates a conventional reversal photographic element containing a silver haloiodide grains modified by the incorporation of a small proportion of fogged silver halide grains. Hayashi et al German OLS No. 3,402,840 is similar to Groet, but describes the imaging silver halide grains in terms of those larger than and smaller than 0.3 micrometer and additionally requires in addition to the fogged silver halide grains or their metal or metal sulfide equivalent an organic compound capable of forming a silver salt of low solubility.

High aspect ratio tabular grain silver haloiodide emulsions have been recognized to provide a variety of photographic advantages, such as improvements in speed-granularity relationships, increased image sharpness, and reduced blue speed of minus blue recording emulsion layers. High aspect ratio tabular grain silver haloiodide emulsions in reversal photographic elements are illustrated by Research Disclosure Vol. 225, January 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501. Research Disclosure is published by Kenneth Mason Publications, Ltd., The Old Harbourmaster's, 8 North Street, Emsworth, Hampshire P010 7DD, England.

U.S. Pat. No. 4,656,122 describes silver halide photographic elements capable of producing reversal images including one emulsion layer comprising a blend of tabular silver haloiodide grains and fine grains of a silver salt more soluble than silver iodide. The addition of relatively fine grains consisting essentially of a silver salt more soluble than silver iodide to an image forming layer containing tabular silver haloiodide grains may produce a combination of advantages in reversal imaging. The reversal threshold speed of the reversal photographic elements can be increased. At the same time, reduced toe region density in the reversal image as well as increases in maximum density and contrast are observed.

In U.S. Pat. No. 5,391,468, the addition of dye to high solubility fine grains which are added to an imaging emulsion layer is described. No discussion is present of inter or outerlayers. Again, in U.S. Pat. No. 5,176,990, the dual melting of a liquid emulsion to imaging emulsion layers is described.

U.S. Pat. No. 5,552,265 teaches the use of a small amount of fine grains below the bottom layer to add to the Dmin of the red recording. U.S. Pat. No. 4,614,707 also describes the use of Lippmann emulsions and Dox scavengers below the slow layer to sharpen the toe contrast.

The addition of Lippmann emulsions in interlayers to intercept inhibitor has been described in GB 1,201,110 for reversal films and in U.S. Pat. No. 4,752,558 for color negative film.

Imaging dyes used in photographic materials generally have unwanted light absorption which reduce color saturation and may cause loss of color accuracy. Techniques for generating interimage effect (IIE) upon photographic processing are known which will compensate such unwanted light absorption to a certain extent. A recent trend in photographic materials has led to the desire for increased color saturation in various applications. Therefore, techniques for providing more interimage effect would be desirable.

U.S. Pat. No. 5,932,401 discloses a new reversal photographic element film structure which enhances interimage effect by combining a light sensitive imaging emulsion and a relatively large amount of a non-image forming fine grain emulsion in a substantially non-image forming special layer of the element. The use of very fine grain non-image forming emulsions (e.g., preferably less than 0.07 micrometer grain size) is preferred in the special layer to provide a relatively large surface area ratio relative to the imaging emulsion grain surface area to enhance interimage effects. Examples include the use of non-image forming emulsions which do and which do not include iodide.

While interimage effect is increased at all density regions for reversal elements when employing a special layer in accordance with U.S. Pat. No. 5,932,401, it has been found that the effect at mid and high density regions (corresponding to mid and low exposure levels) is enhanced to a greater degree than at low density regions (corresponding to high exposure levels). It would be desirable to further increase the interimage effect over all densities of the image forming element, and in particular in low density regions, to provide higher color saturation in such regions.

SUMMARY OF THE INVENTION

It has been found that the addition of a second larger non-image forming silver halide emulsion comprising iodide to a special substantially non-image forming layer comprising an imaging emulsion and a first non-image forming emulsion, or the use of a very polydisperse non-image forming silver halide emulsion comprising iodide in the special layer, results in an enhanced interimage effect in low density regions of a processed reversal element, relative to the effect achieved with single non-image forming emulsion which are not very polydisperse at equal silver laydown.

In accordance with one embodiment of the invention, a reversal photographic element is disclosed comprising a support and, coated on said support, at least one image recording emulsion layer comprised of a dispersing medium and radiation sensitive silver halide grains and at least one substantially non-image forming layer comprising: a) a light sensitive silver halide imaging emulsion which is less than 10 percent of the mass of the total imaging emulsion in the element; b) a first non-image forming silver salt emulsion having an average grain size less than 0.15 μm; and c) a second non-image forming silver salt emulsion comprising iodide having an average grain size greater than that of the first non-image forming emulsion; wherein in the substantially non-image forming layer the surface area ratio of the grains of the non-image forming emulsions to the grains of the imaging emulsion is more than 2:1.

In accordance with a second embodiment of the invention, a reversal photographic element is disclosed comprising a support and, coated on said support, at least one image recording emulsion layer comprised of a dispersing medium and radiation sensitive silver halide grains and at least one substantially non-image forming layer comprising: a) a light sensitive silver halide imaging emulsion which is less than 10 percent of the mass of the total imaging emulsion in the element; and b) a polydisperse non-image forming silver salt emulsion comprising iodide and having an average grain size less than 0.15 μm and a coefficient of variation of at least 50%; wherein in the substantially non-image forming layer the surface area ratio of the grains of the non-image forming emulsion to the grains of the imaging emulsion is more than 2:1.

In preferred embodiments, the elements of the invention are multicolor photographic elements capable of forming a variable reversal dye image, and comprise a blue recording yellow dye image forming layer unit; a green recording magenta dye image forming layer unit; and a red recording cyan dye image forming layer unit coated on a support in addition to a substantially non-image forming layer as described above. The combination of the imaging and non-imaging emulsions in the special substantially non-image forming layer gives an increase in interlayer interimage effects, increasing the color of the film.

DETAILED DESCRIPTION OF THE PREFERRED EMBODIMENTS

Figure 1:
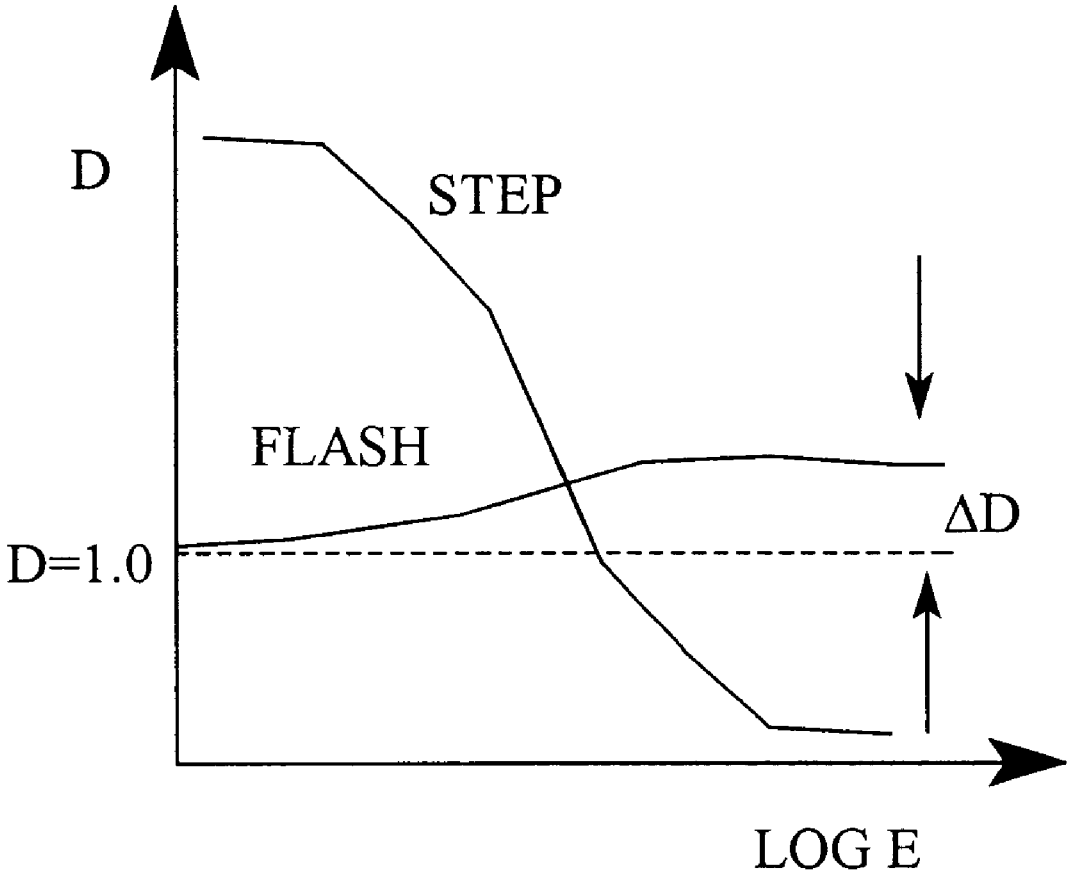
FIG. 1 illustrates the measurement of ΔD interimage response as described in Example 1.

This invention relates to an improvement in silver halide photographic elements useful in reversal imaging. The photographic elements are comprised of a support and one or more image recording silver halide emulsion layers coated on the support. One or more of the image recording emulsion layers contains a dispersing medium and radiation sensitive materials containing silver salts such as tabular silver haloiodide grains.

Photographic element typically consists of imaging layers and non-imaging interlayers. Imaging layers could be red, green or blue light sensitive producing cyan, magenta and yellow dye in subtractive color system. The red, green, or blue color records can be of any order, but multi-color photographic element typically have red, green, blue color records (in that order) above the support and interlayers in between color records. Typically a blue light filtration interlayer is added below the blue color record to reduce the blue light exposure of the green and red light sensitive emulsions. A green light filtration interlayer is added below the green color record to reduce the green light exposure of the red light sensitive emulsion. Non-imaging layers include AHU (antihalation undercoat), interlayer, overcoat layers for UV protection and anti-static.

Each color record may contain several emulsions with varying light sensitivity. Each color record may also contain more than one layer, each layer may contain one or more than one type of imaging emulsion plus some non-imaging fine grain emulsions. The layers of the same color records can be coated next to each other, or could be separated or interleaved with other color records. Oxidized developer (Dox) scavenger(s) are sometime employed either in the imaging emulsion layer or in a separate interlayer. This is well understood by those skilled in the art.

In addition to the imaging layer(s), the invention requires a special substantially non-image forming layer. This special layer must be located outside of the image forming layers. It can be located below all imaging emulsion layers (i.e., in an AHU or other undercoat layers), above all imaging emulsion layer (i.e., in an overcoat), or it can be between two imaging emulsion layers (i.e., in an interlayer). This special layer consists of imaging emulsion and non-image forming fine grain emulsion. This special layer may contain no imaging forming coupler, or may contain a small amount of coupler relative to the total amount of coupler contained in the whole photographic element. The special inter or overcoat layer or layers should not contain more than 20% of color couplers of the same color used in the imaging layer(s). Therefore, this special layer is substantially non-image forming. "Substantially non-image forming" means that less than 20% of any dye produced in the film corresponding to a particular color segment is produced in this layer. Preferably, less than 7% of any dye corresponding to a particular color segment is produced in this layer. Thus, this invention is not directed towards providing the function of the toe speed improving mechanism as disclosed in U.S. Pat. No. 4,656,122.

The imaging emulsions used in the imaging layer(s) of the photographic element can be, for example, of convention 3-dimensional morphology or of tabular grain morphology. The imaging emulsion in the special layer could be the same as an imaging emulsion used in an imaging layer, a combination thereof, or it can be another type of imaging emulsion not used in the imaging layers. The imaging emulsions can be of any type of halide composition. The imaging emulsions can be chemical sensitized by any method known in the art. The imaging emulsions can be over-sensitized by any method known in the art. The imaging emulsions can be over-sensitized for extra light sensitivity at the expense of higher fog. The spectral sensitization of the imaging emulsion in the special layer can be made with similar sensitization dye as the imaging emulsions in the imaging records, or made with different sensitization dye, or made with sensitization dyes from more than one color record. Any means known to improve the spectral sensitizing dye absorption or stability could be applied to the imaging emulsion used in the special layer.

This invention can be combined with development accelerators (e.g. Lanothane as described in U.S. Pat. No. 5,041,367), surface fogged emulsion, CLS (Carey Lea Silver), internally fogged emulsions or internally sensitized emulsion either in the special substantially non-image forming layer or outside the layer.

The special layer, if placed in an overcoat layer, can be in various positions. It is not necessary to have this layer below the UV protection layer, but it is preferable to have it below the UV layer or merged with the UV layer into one layer.

It is preferred to add Dox scavenger in the special layer or in a non-imaging layer(s) adjacent to this layer.

This invention can be combined with the use of bleach accelerator releasing compound or a high efficiency coupler to reduce total Ag laydown.

In a preferred embodiment of the invention, an imaging layer is employed which comprises a blend of tabular silver haloiodide grains and fine grains of a silver salt more soluble than silver iodide as described, e.g., in U.S. Pat. No. 4,656,122 referenced above. Tabular grains are herein defined as those having two substantially parallel crystal faces, each of which is clearly larger than any other single crystal face of the grain. Where tabular grains are employed in a blended grain emulsion layers forming one or more layers of the reversal photographic elements of this invention, they are preferably chosen so that the tabular grains having a thickness of less than 0.5 μm have an average aspect ratio of greater than 8:1 and account for at least 35 percent of the total grain projected area of the blended grain emulsion layer in which they are present.

A convenient approach for preparing blended grain emulsion layers is to blend a radiation sensitive high aspect ratio tabular grain emulsion. The term "high aspect ratio tabular grain emulsion" is herein defined as requiring that the tabular silver halide grains having a thickness of less than 0.3 μm have an average aspect ratio of greater than 8:1 and account for at least 50 percent of the total projected area of the grains present in the emulsion.

In general, tabular grains are preferred having a thickness of less than 0.3 μm. Where the emulsion layer is intended to record blue light as opposed to green or red light, it is advantageous to increase the thickness criterion of the tabular grains to less than 0.5 μm, instead of less than 0.3 μm. Such an increase in tabular grain thickness is also contemplated for applications in which the reversal image is to be viewed without enlargement or where granularity is of little importance, although these latter applications are relatively rare in reversal imaging, reversal images being most commonly viewed by projection. Tabular grain emulsions wherein the tabular grains have a thickness of less than 0.5 μm intended for recording blue light are disclosed by, e.g., Kofron et al U.S. Pat. No. 4,439,520, cited above.

While the tabular grains satisfying the 0.3 μm thickness criterion account for at least 50 percent of the total projected area of the grains in high aspect ratio tabular grain emulsions, it is appreciated that in blending a second grain population the tabular grain percentage of the total grain projected area is decreased.

Thus, it is apparent that while high aspect ratio tabular grain emulsions are preferred for preparing blended grain emulsions and in a highly preferred form the blended grain emulsions are themselves high aspect ratio tabular grain emulsions, this is not necessary in all instances, and departures can actually be advantageous for specific applications. However, for simplicity the ensuing discussion relating to radiation sensitive tabular grain emulsions is directed to the preferred high aspect ratio tabular grain emulsions, it being appreciated that the teachings are generally applicable to tabular grain emulsions as herein defined.

The preferred high aspect ratio tabular grain silver haloiodide emulsions are those wherein the silver haloiodide grains having a thickness of less than 0.3 μm (optimally less than 0.2 μm) have an average aspect ratio of at least 12:1 and optimally at least 20:1. In a preferred form of the invention these silver haloiodide grains satisfying the above thickness and diameter criteria account for at least 70 percent and optimally at least 90 percent of the total projected area of the silver halide grains. In a highly preferred form of the invention the blended grain emulsions required by this invention also satisfy the parameters set out for the preferred high aspect ratio tabular grain emulsions.

It is appreciated that the thinner the tabular grains accounting for a given percentage of the projected area, the higher the average aspect ratio of the emulsion. Typically the tabular grains have an average thickness of at least 0.03 μm, although even thinner tabular grains can in principle be employed.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions of this invention are a function of the maximum average grain diameters acceptable for the specific photographic application and the minimum attainable tabular grain thicknesses which can be conveniently produced. Maximum average aspect ratios have been observed to vary, depending upon the precipitation technique employed and the tabular grain halide composition. High aspect ratio tabular grain silver haloiodide emulsions with average aspect ratios of 100:1, 200:1, or even higher are obtainable by double-jet precipitation procedures.

The tabular haloiodide grains employed in preferred embodiments of this invention contain in addition to iodide at least one of bromide and chloride. Thus, the silver haloiodides specifically contemplated are silver bromoiodides, silver chlorobromoiodides, and silver chloroiodides. Silver bromoiodide emulsions generally exhibit higher photographic speeds and are for this reason the preferred and most commonly employed emulsions for candid photography.

Iodide is preferably present in the tabular silver haloiodide grains in a concentration sufficient to influence photographic performance. It is thus contemplated that at least about 0.5 mole percent iodide will be present in the tabular silver haloiodide grains. However, high levels of iodide are not required to achieve the advantages of this invention. Generally the tabular silver haloiodide grains contain less than 8 mole percent iodide. Preferred iodide levels in the tabular silver haloiodide grains are from 1 to 7 mole percent and optimally are from 2 to 6 mole percent. All of the above iodide mole percentages are based on total silver present in the tabular grains.

The radiation sensitive tabular haloiodide grains present in preferred embodiments of this invention are preferably provided by selecting from among the various high aspect ratio tabular grain emulsions disclosed in Research Disclosure Vol. 225, January 1983, Item 22534; Wilgus et al U.S. Pat. No. 4,434,226; Kofron et al U.S. Pat. No. 4,439,520; Solberg et al U.S. Pat. No. 4,433,048; Maskasky U.S. Pat. No. 4,400,463; and Maskasky U.S. Pat. No. 4,435,501; each cited above, which disclose high aspect ratio tabular grain emulsions wherein tabular silver haloiodide grains having a thickness of less than 0.5 μm (preferably 0.3 μm and optimally 0.2 μm), a diameter of at least 0.6 μm, and an average aspect ratio of greater than 8:1 (preferably at least 12:1 and optimally at least 20:1) account for at least 50 (preferably 70 and optimally 90) percent of the total grain projected area.

U.S. Pat. Nos. 4,672,027 and 4,693,964 disclose haloiodide emulsions, specifically bromoiodide emulsions, having a mean diameter in the range of from 0.2 to 0.55 μm including tabular grains having an aspect ratio of greater than 8:1 (preferably at least 12:1) accounting for at least 50 (preferably 70 and optimally 90) percent of the total grains in the emulsion layer. These emulsions are disclosed to exhibit low levels of light scattering when coated over one or more remaining imaging layers. Once the basic precipitation procedure is appreciated, adjustment of other preparation parameters can, if desired, be undertaken by routine optimization techniques.

The blended grain emulsions employed in imaging layers in accordance with preferred embodiments of the invention can be conveniently provided by blending with a tabular grain silver haloiodide emulsion as described above a second grain population consisting essentially of silver salt which is more soluble than silver iodide. The silver salt should be sufficiently insoluble that it is capable of forming a grain rather than being present in a solubilized form. Useful silver salts can be chosen from among those having a solubility product constant in the range 9.5 to less than 16. Preferred silver salts are those having a solubility product constant in the range of from 9.75 to 15.5, optimally from 11 to 13. Unless otherwise stated, all solubility product constants are referenced to a temperature of 20° C. A discussion and listing of solubility product constants for exemplary silver salts is presented by James, Theory of the Photographic Process, 4th Ed., Macmillan, 1977, Chapter 1, Sections F, G, and H, pp. 5–10.

The reversal photographic elements can take the form of either black-and-white or color reversal photographic elements. In a very simple form the reversal photographic elements according to this invention can be comprised of a conventional photographic support, such as a transparent film support, onto which is coated an imaging emulsion layer as described above with the special substantially non-imaging layer of this invention. Following imagewise exposure, silver halide is imagewise developed to produce a first silver image, which need not be viewable. The first silver image can be removed by bleaching before further development when a silver or silver enhanced dye reversal image is desired. Thereafter, the residual silver halide is uniformly rendered developable by exposure or by fogging. Development produces a reversal image. The reversal image can be either a silver image, a silver enhanced dye image, or a dye image only, depending upon the specific choice of conventional processing techniques employed. The production of silver reversal images is described by Mason, Photographic Processing Chemistry, 1966. Focal Press Ltd., pp. 160–161. If a dye only image is being produced, silver bleaching is usually deferred until after the final dye image is formed.

The reversal photographic elements of this invention are preferably color reversal photographic elements capable of producing multicolor images—e.g., images that at least approximately replicate subject colors. Illustrative of such color reversal photographic elements are those disclosed by Kofron et al U.S. Pat. No. 4,439,520 and Groet U.S. Pat. No. 4,082,553, each cited above and here incorporated by reference. In a simple form such a color reversal photographic element can be comprised of a support having coated thereon at least three color forming layer units, including a blue recording yellow dye image forming layer unit, a green recording magenta dye image forming layer unit, and a red recording cyan dye image forming layer unit. Each color forming layer unit is comprised of at least one radiation sensitive silver halide emulsion layer. In a preferred form of the invention at least one radiation sensitive emulsion layer in each color forming layer unit is comprised of a blended grain emulsion as described above. The blended grain emulsions in each color forming layer unit can be chemically and spectrally sensitized as taught by Kofron et al U.S. Pat. No. 4,439,520. In a preferred form chemical and spectral sensitization of the tabular grain emulsion is completed before blending with the second grain population, which therefore remains substantially free of sensitizing materials. One or more dye image providing materials, such as couplers, are preferably incorporated in each color forming layer unit, but can alternatively be introduced into the photographic element during processing.

The following constitutes a specific illustration of a color reversal photographic element according to this invention.

I. Photographic Support

Exemplary preferred photographic supports include cellulose acetate, poly(ethylene terephthalate), and poly (ethylene naphthalate) film supports. Other possible supports include glass and photographic paper supports.

II. Subbing Layer

To facilitate coating on the photographic support it is preferred to provide a gelatin or other conventional subbing layer.

III. Red Recording Layer Unit

At least one layer comprised of a red sensitized blended grain high aspect ratio tabular grain silver haloiodide emulsion layer, as described in detail above. In an emulsion layer or in a layer adjacent thereto at least one conventional cyan dye image forming coupler is included, such as, for example, one of the cyan dye image forming couplers disclosed in U.S. Pat. Nos. 2,423,730; 2,706,684; 2,725,292; 2,772,161; 2,772,162; 2,801,171; 2,895,826; 2,908,573; 2,920,961; 2,976,146; 3,002,836; 3,034,892; 3,148,062; 3,214,437; 3,227,554; 3,253,924; 3,311,476; 3,419,390; 3,458,315; and 3,476,563.

IV. Interlayer

At least one hydrophilic colloid interlayer, preferably a gelatin interlayer which includes a reducing agent, such as an aminophenol or an alkyl substituted hydroquinone, is provided to act as an oxidized developing agent scavenger.

V. Green Recording Layer Unit

At least one layer comprised of a green sensitized blended grain high aspect ratio tabular grain silver haloiodide emulsion layer, as described in detail above. In an emulsion layer or in a layer adjacent thereto at least one conventional magenta dye image forming coupler is included, such as, for example, one of the magenta dye image forming couplers disclosed in U.S. Pat. Nos. 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,432,521; and 3,519,429.

VI. Yellow Filter Layer

A yellow filter layer is provided for the purpose of absorbing blue light. The yellow filter layer can take any convenient conventional form, such as a gelatino-yellow colloidal silver layer (i.e., a Carey Lea silver layer) or a yellow dye containing gelatin layer. In addition the filter layer contains a reducing agent acting as an oxidized developing agent scavenger, as described above in connection with the Interlayer IV.

VII. Blue Recording Layer Unit

At least one layer comprised of a blue sensitized blended grain high aspect ratio tabular grain silver haloiodide emulsion layer, as described in detail above. In an alternative form the tabular grains can be thicker than high aspect ratio tabular grains—that is, the thickness criteria for the grains can be increased from 0.3 μm to less than 0.5 μm, as described above. In this instance the grains exhibit more native blue speed, which preferably is augmented by the use of blue spectral sensitizers, although this is not essential, except for the highest attainable blue speeds. In an emulsion layer or in a layer adjacent thereto at least one conventional yellow dye image forming coupler is included, such, as, for example, one of the yellow dye image forming couplers disclosed in U.S. Pat. Nos. 2,875,057; 2,895,826; 2,908,573; 2,920,961; 3,148,062; 3,227,554; 3,253,924; 3,265,506; 3,277,155; 3,369,895; 3,384,657; 3,408,194; 3,415,652; and 3,447,928.

VIII. Special Substantially Non-image Forming Layer

The special layer in accordance with one embodiment of the invention contains a) a first grain population containing red, blue, or green light sensitive silver halide imaging emulsion which is less than 10 percent of the mass of the total imaging emulsion in the element; b) a first non-image forming silver salt emulsion having an average grain size less than 0.15 μm; and c) a second non-image forming silver salt emulsion comprising iodide having an average grain size greater than that of the first non-image forming emulsion; wherein the grain population of the first non-image forming emulsion is more soluble than the most insoluble species of the image forming emulsion, and the surface area ratio of the grains of the non-image forming emulsions to the grains of the imaging emulsion is more than 2:1. Preferably the molar ratio of the grain population of the non-image forming emulsions to that of the imaging emulsion is greater than 3:2 and the surface area ratio of the grains of the non-image forming emulsions to the grains of the imaging emulsion is more than 2:1.

The use of a blend of non-image forming emulsions of different sizes wherein the larger of the two non-image forming emulsions comprises iodide as described above has been found to be particularly useful for promoting interimage effect at low density regions. The low density region in a reversal image corresponds to relatively high exposure levels. The imaging emulsion in the special layer is fully exposed in such region, and upon processing is developed completely. Such chemically developed emulsion grains act to dissolve the non-image forming fine grain component in the same layer by solution physical development. Solution physical development is a development process which results when certain developers, most notably Process E-6 black and white developers used with color reversal films, are utilized (see The Mechanism of Development in The Theory of the Photographic Process, fourth edition, edited by T. H. James, Macmillan Publishing Co., New York). The chemical development process in the mid and high density regions (corresponding to mid and low exposure level regions) is not as fast as in the low density (high exposure) regions, as the completeness of chemical development of the imaging emulsion in the high exposure region leads to relatively rapid dissolution of the non-image forming emulsion. Where the non-image forming emulsion comprises iodide which impacts IIE, such iodide can accordingly be released too soon in the low density regions, and not sustained throughout the whole duration of the first reversal processing development step, in contrast to the mid and high density regions, where the chemical development is not as fast and the non-image forming emulsion fine grain component is dissolved and iodide is released more slowly. The special layer in accordance with the present invention controls iodide release from the non-image forming emulsion in the special layer by incorporating iodide in relatively larger grains of the non-image forming emulsion present in the layer, which larger grains are not dissolved as quickly as the smaller grains of the non-image forming emulsion in the special layer, while still also employing smaller non-image forming emulsion grains to provide a high surface area ratio.

In accordance with preferred embodiments of the invention, at least the second (i.e., the larger of two) non-image forming emulsion in the special layer comprises from 1–15 mole percent iodide. More preferably, each of the first and second non-image forming emulsions in the special layer comprise iodide, most preferably at from 1–15 mole percent. The first (i.e., smaller of the two) non-image forming emulsion in the special layer preferably has an average grain size of less than about 0.1 micrometer, more preferably less than about 0.07 micrometer and most preferably less than or equal to about 0.05 micrometer, while the average grain size of the second non-image forming emulsion is preferably greater than about 0.1 micrometer, and may even be greater than 0.2, or 0.3 or even 0.4 micrometer. In accordance with a particular embodiment, the second non-image forming emulsion in the special layer preferably has an average grain size at least twice that of the first non-image forming emulsion.

In accordance with a particular embodiment of the invention, the first non-image forming emulsion preferably comprises at least 30 weight % and more preferably at least 50 weight %, and the second non-image forming emulsion preferably comprises at least 10 weight % and more preferably at least 20 weight %, of the total non-image forming emulsion in the special layer.

While the special layer in accordance with one embodiment of the invention comprises at least two distinct (i.e., a first and a second) non-image forming emulsions of different average grain sizes wherein at least the larger of such two non-image forming emulsions comprises iodide as described above, an alternative embodiment includes the use of a polydisperse emulsion having a coefficient of variation of at least 50% and which comprises iodide, either alone or in combination with additional monodisperse or polydisperse non-image forming emulsions. Silver halide emulsions of narrower and broader grain size distributions are often distinguished by being characterized as "monodisperse" and "polydisperse" emulsions, respectively. Dispersity may be defined in terms of the emulsion grain size coefficient of variation. As employed herein the coefficient of variation is defined as 100 times the standard deviation of the grain diameters divided by the mean grain diameter. From this definition it is apparent that as between emulsions of identical coefficients of variation those having lower mean grain diameters exhibit a lower range of grain sizes present. Polydisperse emulsions can be obtained directly by precipitating silver halide grains, or by mixing monodisperse emulsions of different mean sizes. The technique of mixing monodisperse emulsions enables emulsions to be obtained with a particularly reproducible polydispersity.

It is an important feature of the invention that the non-image forming emulsion grain populations are incapable of forming a latent image extending the exposure latitude imparted to the layer by the imaging emulsion grains. When the imaging emulsion grains have received sufficient light exposure to reach their maximum level of developability, the non-image forming emulsion grain populations have not yet reached a threshold exposure for producing a latent image. The non-image forming emulsion grain populations need not be capable of forming a latent image at any level of exposure, since the latent image forming capability of such grain population is not utilized in enhancing reversal imaging characteristics. This is what is meant by "non-image forming". However, use of a fine grain population having a latent image forming capability is not excluded from the practice of the invention, provided its threshold exposure level is beyond the intended exposure latitude of the photographic element. Thus, the non-image forming emulsion grain populations preferably require at least 0.3 log E greater exposure than that required to bring the imaging emulsion grains to a maximum level of developability. The relative insensitivity of the non-image forming emulsion grain populations to exposing radiation as compared to the imaging emulsion grains can result from the difference in their mean diameters, the imaging emulsion grains in most instances having the larger mean diameter. In most instances and preferably the difference in radiation sensitivity of the imaging and non-image forming emulsion grain populations is increased by chemically sensitizing and/or spectrally sensitizing the only the imaging emulsion grains. Although not required, conventional techniques for desensitizing the non-image forming emulsion grain populations can, if desired, be employed. Zelikman et al Making and Coating Photographic Emulsions, Focal Press, 1964, pp. 234–237, illustrate the concept of extending exposure latitude.

It is generally most convenient to prepare the emulsions required for the practice of this invention by blending a tabular silver haloiodide grain emulsion, preferably after sensitization, and a separately prepared emulsion containing the relatively fine non-image forming emulsion grain populations. The non-image forming emulsions can, for example, take the form of a relatively fine grain silver halide emulsions, the preparations of which are well known to those skilled in the art and form no part of this invention. The relatively fine grain non-image forming emulsion population of grains can comprise, e.g., Lippmann, fine cubic emulsion, or fine tabular grain emulsions. The non-image forming emulsion is optimally a Lippmann emulsion. So long as the grain requirements identified above are satisfied, either or both of the imaging and non-image forming emulsions can themselves be the product of further conventional grain blending.

The imaging emulsion grain population in the special layer must contain less than 10 percent of the mass of the total imaging emulsion in the element. This means that if the blue, green, and red record each has 1 g/m$^2$ of total of imaging emulsion with the total imaging emulsion 3 g/m$^2$, then the imaging emulsion in this special layer should be less than 3 g/m$^2$ times 10%, which means less than 0.3 g/m$^2$ in this special layer. Preferably, the imaging emulsion grain population in the intercoat or overcoat layer comprises less than 5 percent of the total mass of imaging emulsion in the element.

Preferably, the total molar ratio of the non-image forming emulsion grain population to that of the imaging emulsion grain population is greater than 3:2, more preferably greater than 2:1 and even more preferably greater than 3:1. The total surface area ratio of the non-image forming emulsion grain population to the imaging emulsion grain population is more than 2:1, preferably more than 4:1, and most preferably at least 10:1.

A dye image forming coupler such as C-1, M-1, M-2, Yel-1 may be added to the special layer. The imaging emulsion population of grains in the special layer comprises a red sensitive emulsion, a green sensitive emulsion, a blue sensitive emulsion or any combination thereof.

At least one additional inter or overcoat layer can be provided. Such layers are typically transparent gelatin layers and contain known addenda for enhancing coating, handling, and photographic properties, such as matting agents, surfactants, antistatic agents, ultraviolet absorbers, and similar addenda.

As disclosed by Kofron et al U.S. Pat. No. 4,439,520, the high aspect ratio tabular grain emulsion layers show sufficient differences in blue speed and green or red speed when substantially optimally sensitized to green or red light that the use of a yellow filter layer is not required to achieve acceptable green or red exposure records. It is appreciated that in the absence of a yellow filter layer the color forming layer units can be coated in any desired order on the support. While only a single color forming layer unit is disclosed for recording each of the blue, green, and red exposures, it is appreciated that two, three, or even more color forming layer units can be provided to record any one of blue, green, and red. It is also possible to employ within any or all of the blue, green, and red color forming layers any, some, or all of which satisfy the blended grain emulsion requirements of this invention.

In addition to the features described above the reversal photographic elements can, of course, contain other conventional features known in the art, which can be illustrated by reference to Research Disclosure, vol. 176, December 1978, Item 17643, here incorporated by reference. For example, the silver halide emulsions other than the blended grain emulsions described can be chosen from among those described in Paragraph I; the silver halide emulsions can be chemically sensitized, as described in Paragraph III and/or spectrally sensitized, as described in Paragraph IV, although preferably only the tabular grain silver haloiodide emulsions are sensitized, with the preferred sensitizations those disclosed by Kofton et al U.S. Pat. No. 4,439,520 and Maskasky U.S. Pat. No. 4,435,501; any portion of the elements can contain brighteners, as described in Paragraph V; the emulsion layers can contain antifoggants and stabilizers, as described in Paragraph VI; the color forming layer units can contain color image forming materials as described in Paragraph VII; the elements can contain absorbing and scattering materials, as described in Paragraph VIII; the emulsion and other layers can contain vehicles, as described in Paragraph IX; the hydrophilic colloid and other layers of the elements can contain hardeners, as described in Paragraph X; the layers can contain coating aids, as described in Paragraph XI; the layers can contain plasticizers and lubricants, as described in Paragraph XII; the layers, particularly the layers coated farthest from the support, can contain matting agents, as described in Paragraph XVI; and the supports can be chosen from among those described in Paragraph XVII. In addition conventional time released or imagewise released inhibitors can be used such as those described in U.S. Pat. Nos. 5,567,577 and 3,379,529. This exemplary listing of addenda and features is not intended to restrict or imply the absence of other conventional photographic features compatible with the practice of the invention.

The photographic elements can be imagewise exposed with any various forms of energy, as illustrated by Research Disclosure, Item 17643, cited above, Paragraph XVIII. For multicolor imaging the photographic elements are exposed to visible light.

Multicolor reversal dye images can be formed in photographic elements according to this invention having differentially spectrally sensitized silver halide emulsion layers by black-and-white development followed by color development. Reversal processing is demonstrated below employing conventional reversal processing compositions and procedures.

EXAMPLES

The invention can be better appreciated by reference to the following specific examples. A series of elements of the following layer structure are prepared. In the composition of the layers, the coating amounts are shown as g/m$^2$. Silver halide amounts are given in silver amounts. The following non-image forming silver bromide or silver iodobromide emulsions A–F are used in the examples:

TABLE 1

| Non-image forming emulsion | Average Size (Equiv. Spherical Diam.) (μm) | Iodide (mole percent) |
|---|---|---|
| A | 0.05 | 5 |
| B | 0.11 | 5 |
| C | 0.15 | 5 |
| D | 0.21 | 5 |
| E | 0.05 | 0 |
| F | 0.16 | 0 |

Example 1: A comparative photographic element 1-1 was constructed in the following manner:

Layer 1: Antihalation Layer

| | |
|---|---|
| Layer 1: Antihalation Layer | |
| Black colloidal Silver | 0.25 |
| UV Dye UV-1 | 0.04 |
| Dispersed in Solvent S-1 | 0.04 |
| Gelatin | 2.44 |
| Layer 2: First Interlayer | |
| Fine Grain Silver Bromide 0.055 μm equivalent spherical diameter | 0.05 |
| SCV-1 | 0.05 |
| Gelatin | 1.22 |
| Layer 3: Low speed Red Sensitive Layer | |
| Silver iodobromide emulsion 0.5 μm (diameter) by 0.058 μm (thickness) 4% bulk iodide emulsion spectrally sensitized with dyes SD-0 and SD-1 | 0.25 (as silver) |
| Fine Grain Silver Bromide 0.055 μm equivalent spherical diameter | 0.04 |
| Cyan Coupler C-1 | 0.09 |
| Dispersed in Solvent S-3 | 0.04 |
| Gelatin | 1.08 |
| Layer 4: Medium Speed Red Sensitive Layer | |
| Silver Iodobromide Emulsion 0.88 μm (diameter) by 0.091 μm (thickness) 4% bulk iodide spectrally sensitized with dyes SD-0 and SD-1 | 0.34 (as silver) |
| Fine Grain Silver Bromide 0.055 μm equivalent spherical diameter | 0.05 |
| Cyan Coupler C-1 | 0.41 |
| Dispersed in Solvent S-3 | 0.20 |
| Gelatin | 0.73 |
| Layer 5: High Speed Red Sensitive Layer | |
| Silver Iodobromide Emulsion 1.11 μm (diameter) by 0.103 μm (thickness) 3% bulk iodide spectrally sensitized with dyes SD-0 and SD-1 | 0.46 (as silver) |

-continued

| | |
|---|---|
| Fine Grain Silver Bromide 0.15 μm equivalent spherical diameter 4.8% bulk iodide spectrally sensitized | 0.05 |
| Fine Grain Silver Bromide 0.055 μm equivalent spherical diameter | 0.03 |
| Cyan Coupler C-1 | 0.70 |
| Dispersed in Solvent S-3 | 0.35 |
| Gelatin | 1.19 |
| Layer 6: Second Interlayer | |
| Filter Dye FD-1 | 0.06 |
| Inhibitor I-1 | 0.001 |
| SCV-1 | 0.16 |
| Gelatin | 0.81 |
| Layer 7: Third Interlayer: | |
| Gelatin | 0.61 |
| Layer 8: Low Speed Green Sensitive Layer | |
| Silver Iodobromide Emulsion 0.44 μm (diameter) by 0.057 μm (thickness) 4% bulk iodide spectrally sensitized with dyes SD-4 and SD-5 | 0.3 1 (as silver) |
| Fine Grain Silver Bromide 0.055 μm equivalent spherical diameter | 0.04 (as silver) |
| Magenta Coupler M-1 | 0.07 |
| Magenta Coupler M-2 | 0.03 |
| co-dispersed in Solvent S-2 | 0.05 |
| Gelatin | 0.47 |
| Layer 9: Medium Speed Green Sensitive Layer | |
| Silver Iodobromide Emulsion 0.64 μm (diameter) by 0.105 μm (thickness) 3% bulk iodide spectrally sensitized with dyes SD-4 and SD-5 | 0.38 (as silver) |
| Magenta Coupler M-1 | 0.34 |
| Magenta Coupler M-2 | 0.15 |
| Co-dispersed in Solvent S-2 | 0.25 |
| Gelatin | 0.91 |
| Layer 10: High Speed Green Sensitive Layer | |
| Silver Iodobromide Emulsion 1.26 μm (diameter) by 0.137 μm (thickness) 3% bulk iodide spectrally sensitized with dyes SD-4 and SD-5 | 0.54 (as silver) |
| Fine Grain Silver Iodobromide emulsion 0.15 μm equivalent spherical diameter 4.8% bulk iodide spectrally sensitized | 0.04 (as silver) |
| Magenta Coupler M-1 | 0.72 |
| Magenta Coupler M-2 | 0.31 |
| Co-dispersed in Solvent S-2 | 0.52 |
| Gelatin | 1.78 |
| Layer 11: Fourth Interlayer | |
| Gelatin | 0.61 |
| Layer 12: Fifth Interlayer | |
| Carey Lea Silver | 0.07 |
| SCV-1 | 0.11 |
| Gelatin | 0.68 |
| Layer 13: Low Speed Blue Sensitive Layer | |
| Silver Iodobromide Emulsion 1.04 μm (diameter) by 0.125 μm (thickness) 3% bulk iodide spectrally sensitized with dyes SD-6 and Sd-7 | 0.22 (as silver) |
| Silver Iodobromide Emulsion 0.50 μm (diameter) by 0.130 μm (thickness) 3% bulk iodide spectrally sensitized with dyes SD-6 and SD-7 | 0.15 (as silver) |
| Yellow Coupler YEL-1 | 0.89 |
| Dispersed in Solvent S-3 | 0.30 |
| Gelatin | 1.23 |
| Layer 14: High Speed Blue Sensitive Layer | |
| Silver Iodobromide Emulsion 2.59 μm (diameter) by 0.154 μm (thickness) | 0.67 (as silver) |

-continued

| | |
|---|---|
| 2% bulk iodide spectrally sensitized with dyes SD-6 and SD-7 | |
| Yellow Coupler YEL-1 | 1.53 |
| Dispersed in Solvent S-3 | 0.51 |
| Gelatin | 2.03 |
| Layer 15: First Overcoat | |
| SCV-1 | 0.07 |
| UV Dye UV-4 | 0.41 |
| UV Dye UV-1 | 0.09 |
| Dispersed in Latex L-1 | 0.45 |
| Silver iodobromide emulsion 0.50 μm (diameter) by 0.058 μm (thickness) 4% bulk iodide emulsion spectrally sensitized with dyes SD-0 and SD-1 | 0.09 (as silver) |
| Non-image forming silver iodobromide emulsion A (0.05 μm, 5 mole % iodide) | 0.43 (as silver) |
| Gelatin | 1.40 |
| Layer 16: Second Overcoat | |
| Matte 3.3 μm spherical diameter | 0.02 |
| Gelatin | 0.97 |
| Hardener H-1 | 1.38% of total gel |

Nine additional photographic elements 1-2 to 1-11 are constructed similarly to element 1-1, except non-image forming emulsion A in Layer 15 is replaced with different emulsions or emulsion blends at laydowns according to Table 2 below. The imaging and fine grain non-image forming emulsions are made in different melts and mixed right before coating event (dual melting).

The IIE measurement is described in U.S. Pat. No. 4,082,553 and is described further in FIG. 1. The exposed strips are processed in standard E-6 process. The R on B IIE is measured from step exposure of red record (causer layer) and flash exposure of the blue color record (receiver layer). The ΔD value is report at the blue density at the lowest red exposure. This ΔD value is report at the blue density being D=1.0 (corresponding to a mid exposure level) and D=0.5 (corresponding to a high exposure level) at the lowest red exposure. (Likewise the ΔD for G on B IIE or R on G IIE are similarly measured).

The metric ΔD is a measure of IIE response. It characterizes the increase in density of the flashed record caused by the decrease in density of the stepped record.

TABLE 2

| | Non-image forming Emulsion in Layer 15 | | Non-image: imaging emulsion | R on B IIE (@D = 0.5) ΔD | R on B IIE (@D = 1.0 Δ D |
|---|---|---|---|---|---|
| Example | Type | Laydown (g/m$^2$) | surface area ratio | (Relative to 1-1) | (Relative to 1-1) |
| 1-1,check | A | 0.43 | 13.5 | — | — |
| 1-2, comparison | B | 0.43 | 6.1 | Slight worse | Worse |
| 1-3, comparison | C | 0.43 | 4.5 | Slight worse | Worse |
| 1-4, comparison | D | 0.43 | 3.2 | Slight worse | Much worse |
| 1-5, comparison | A | 0.86 | 27.0 | Slight better | Better |
| 1-6, invention | A | 0.21 | 9.6 | Slight worse | Worse |
| | B | 0.21 | | | |
| 1-7, invention | A | 0.43 | 16.5 | Better | About equal |
| | B | 0.21 | | | |
| 1-8, invention | A | 0.43 | 15.7 | Better | About equal |
| | C | 0.21 | | | |
| 1-9, invention | A | 0.43 | 15.1 | Better | About equal |
| | D | 0.21 | | | |
| 1-10, invention | A | 0.43 | 18.7 | Better | About equal |
| | B | 0.21 | | | |
| | C | 0.21 | | | |
| 1-11, invention | A | 0.43 | 18.3 | Better | About equal |
| | B | 0.21 | | | |
| | C | 0.10 | | | |
| | D | 0.10 | | | |

The above examples generally illustrate that the interimage at low flash density region is improved when a second larger iodide containing non-image forming emulsion is included in the special layer relative to the interimage obtained from use of the smaller non-image forming emulsion only. Note especially the improvement of examples 1-7 through 1-11 at D=0.5 relative to example 1-5, even though 1-7 through 1-11 have substantially lower surface are ratios. The slightly worse performance of example 1-6 relative to example 1-1 is apparently due to an increased impact of lower surface area ratio at the lower emulsion laydown level. Such example would be expected to demonstrate improved performance in accordance with the invention relative to an example employing only smaller non-imaging emulsions at a similar surface area ratio.

Example 2- A second check photographic element 2-1 is constructed in a similar manner as element 1-1, except a pure silver bromide non-image forming emulsion E is used in Layer 15 in place of silver iodobromide emulsion A. Additional comparison and invention elements 2-2 to 2-7 are constructed similarly to element 2-1, except non-image forming emulsion E in Layer 15 is replaced with different emulsions or emulsion blends at laydowns according to Table 3 below.

TABLE 3

| | Non-image forming Emulsion in Layer 15 | | Non-image: imaging emulsion | R on B IIE (@D = 0.5) ΔD | R on B IIE (@D = 1.0) ΔD |
|---|---|---|---|---|---|
| Example | Type | Laydown (g/m$^2$) | surface area ratio | (Relative to 2-1) | (Relative to 2-1) |
| 2-1, check | E | 0.43 | 13.5 | — | — |
| 2-2, comparison | F | 0.43 | 4.2 | Worse | Worse |
| 2-3, comparison | E | 0.86 | 27.0 | Slight better | Better |
| 2-4, invention | E | 0.21 | 9.6 | Slight worse | Worse |

TABLE 3-continued

| Example | Non-image forming Emulsion in Layer 15 Type | Laydown ($g/m^2$) | Non-image: imaging emulsion surface area ratio | R on B IIE (@D = 0.5) ΔD (Relative to 2-1) | R on B IIE (@D = 1.0) ΔD (Relative to 2-1) |
|---|---|---|---|---|---|
| | B | 0.21 | | | |
| 2-5, invention | E | 0.43 | 16.5 | Better | About equal |
| | B | 0.21 | | | |
| 2-6, invention | E | 0.43 | 15.7 | Better | About equal |
| | C | 0.21 | | | |
| 2-7, invention | E | 0.43 | 18.7 | Better | About equal |
| | B | 0.21 | | | |
| | C | 0.21 | | | |
| 2-8, comparison | E | 0.43 | 15.6 | Equal | Slight better |
| | F | 0.21 | | | |

The above examples generally illustrate that the interimage at low flash density region is improved when a second larger iodide containing non-image forming emulsion is included in the special layer relative to the interimage obtained from use of the smaller non-image forming emulsion only. Note especially the improvement of examples 2-5, 2-6, and 2-7 at D=0.5 relative to example 2-3, even though 2-5, 2-6, and 2-7 have substantially lower surface are ratios. The slightly worse performance of example 2-4 relative to example 2-1 is apparently due to an increased impact of lower surface area ratio at the lower emulsion laydown level. Such example would be expected to demonstrate improved performance in accordance with the invention relative to an example employing only smaller non-imaging emulsions at a similar surface area ratio. The improvement of the invention is not seen when a larger pure silver bromide emulsion is substituted for or added to the smaller emulsion (Examples 2-2 and 2-8). Adding a blend of two pure silver bromide fine grain emulsions of two different sizes to the special layer, or adding a blend of a pure silver bromide fine grain emulsion and a silver iodobromide emulsion of the same size, will produce the average performance obtained from the use of each emulsion of the blend separately.

The components employed for the preparation of light-sensitive materials not already identified above are shown below:

SCV-1:

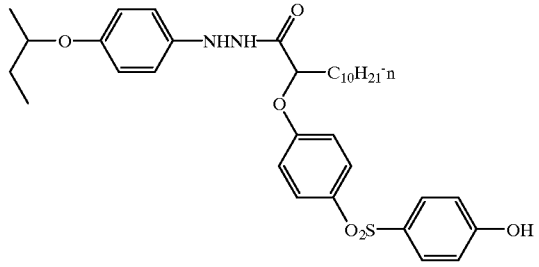

-continued

C-1:

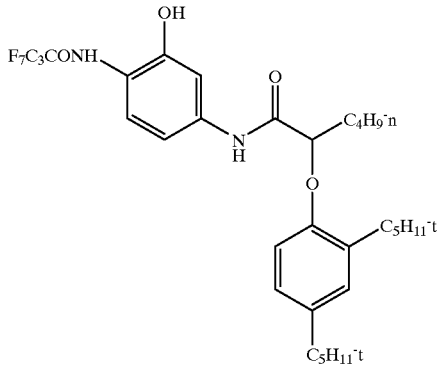

M-1:

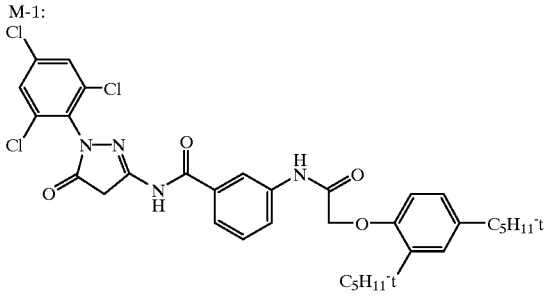

M-2:

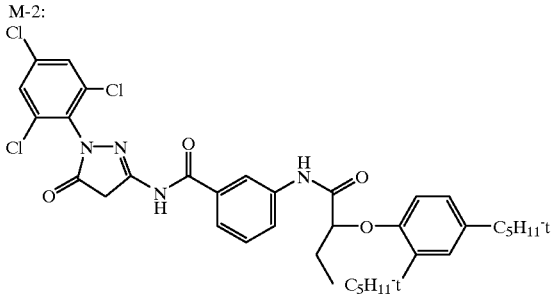

YEL-1:

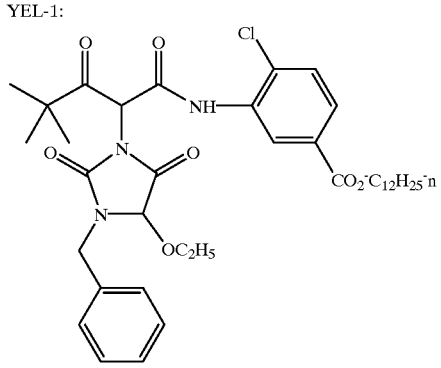

FD-1

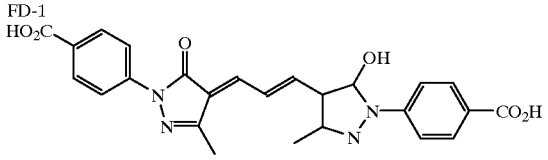

-continued
FD-2
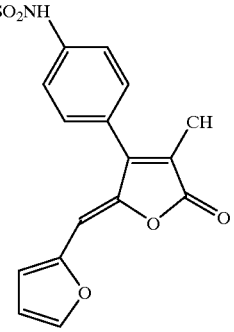
SD-0:
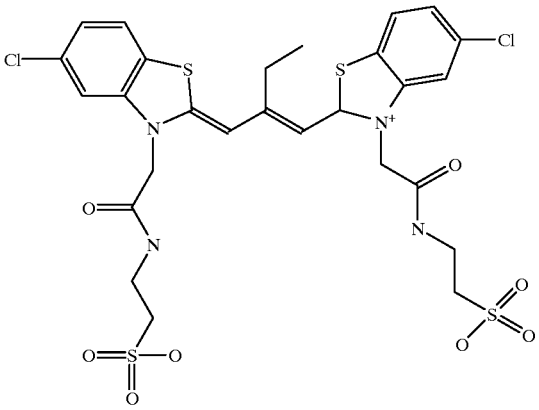
SD-1:
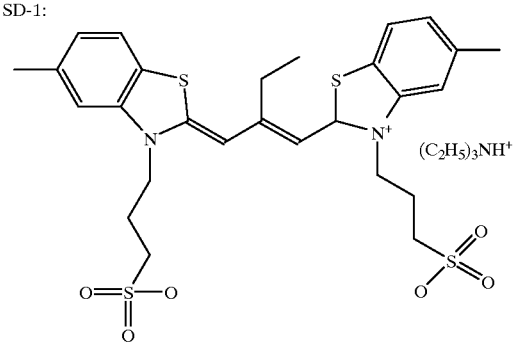
SD-2:
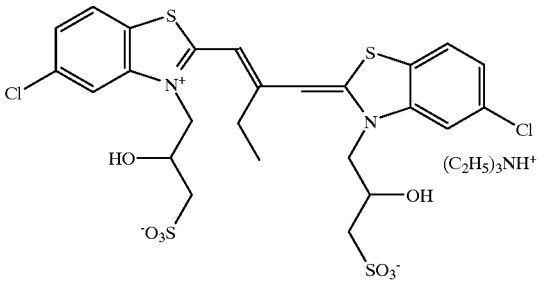
-continued
SD-3:
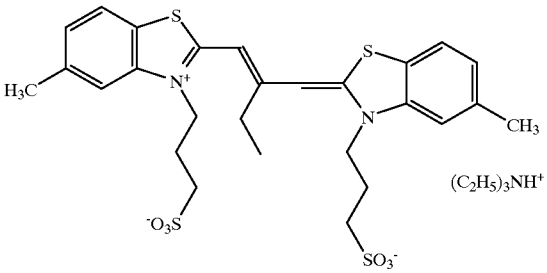
SD-4:
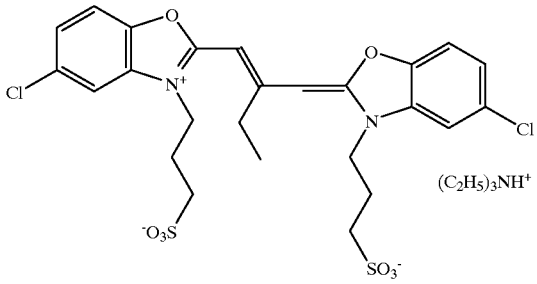
SD-5:
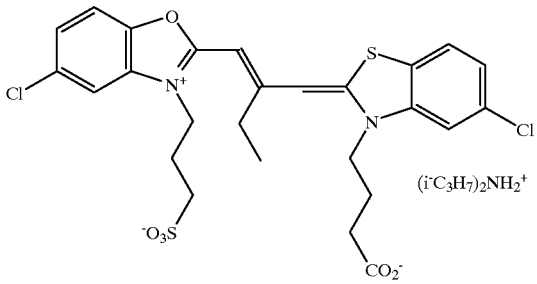
SD-6:
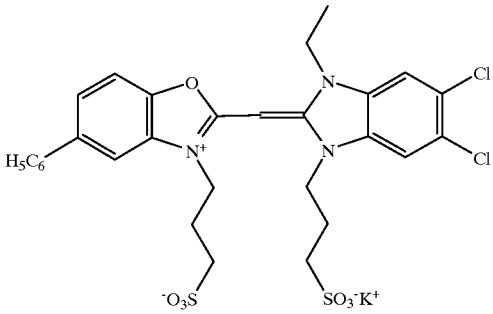
SD-7:
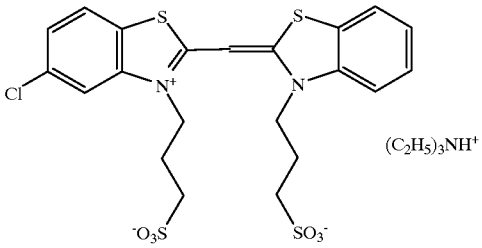

-continued

SD-8:

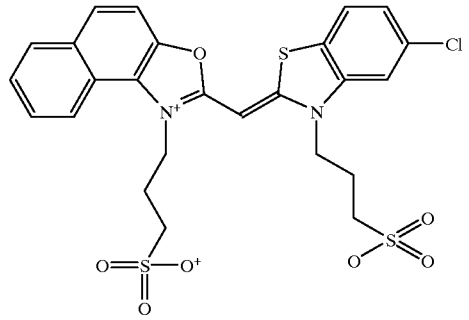

UV-1:

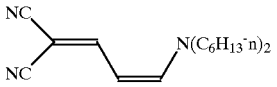

UV-4:
Tinuvin 171 (Ciba Geigy)

I-1

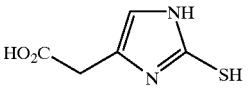

L-1:

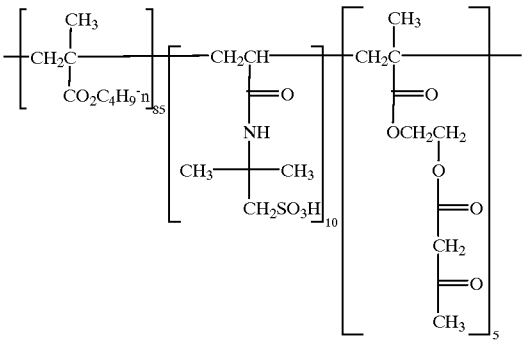

Hardener H-1:
1,1′–[methylenebis(sulfonyl)]bis-ethene

Solvent S-1
1,4-Cyclohexylenedimethylene bis(2-ethylhexanoate)

Solvent S-2
Phosphoric Acid, tris(methylphenyl) ester

Solvent S-3
1,2-benzenedicarboxylic acid, dibutyl ester

While the invention has been described with particular reference to a preferred embodiment, it will be understood by those skilled in the art the various changes can be made and equivalents may be substituted for elements of the preferred embodiment without departing from the scope of the invention.

We claim:

1. A reversal photographic element comprising a support and, coated on said support, at least one image recording emulsion layer comprised of a dispersing medium and radiation sensitive silver salt grains, and at least one substantially non-image forming layer comprising:

a) a light sensitive silver halide imaging emulsion which is less than 10 percent of the mass of the total imaging emulsion in the element;

b) a first non-image forming silver salt emulsion having an average grain size less than 0.15 $\mu$m; and c) a second non-image forming silver salt emulsion comprising iodide having an average grain size greater than that of the first non-image forming emulsion;

wherein in the substantially non-image forming layer the surface area ratio of the grains of the non-image forming emulsions to the grains of the imaging emulsion is more than 2:1.

2. The element of claim 1 wherein the second non-image forming emulsions comprise from about 1–15 mole % iodide.

3. The element of claim 1 wherein each of the first and second non-image forming emulsions comprise from about 1–15 mole % iodide.

4. The element of claim 1 wherein in the substantially non-image forming layer the molar ratio of the total grain population of the non-image forming emulsions to that of the image forming emulsion is greater than 3:2.

5. The photographic element of claim 1 wherein in the substantially non-image forming layer the molar ratio of the total grain population of the non-image forming emulsions to that of the imaging emulsion is greater than 2:1 or the surface area ratio of the grains of the non-image forming emulsions to the grains of the imaging emulsion is more than 4:1.

6. The photographic element of claim 1 wherein in the substantially non-image forming layer the molar ratio of the total grain population of the non-image forming emulsions to that of the imaging emulsion is greater than 3:1 or the surface area ratio of the grains of the non-image forming emulsions to the grains of the imaging emulsion is at least 10:1.

7. The photographic element of claim 1 wherein in the substantially non-image forming layer the surface area ratio of the grains of the non-image forming emulsions to the grains of the imaging emulsion is more than 4:1.

8. The photographic element of claim 1 wherein in the substantially non-image forming layer the surface area ratio of the grains of the non-image forming emulsions to the grains of the imaging emulsion is at least 10:1.

9. The photographic element of claim 1 wherein the substantially non-image forming layer contains a coupler capable of forming image dye in the amount of less than 20% of the maximum image density in the element.

10. The photographic element of claim 1 wherein the average grain size of the first non-image forming emulsion is less than 0.1 $\mu$m and the average grain size of the second non-image forming emulsion is greater than 0.1 $\mu$m.

11. The photographic element of claim 1 wherein the average grain size of the first non-image forming emulsion is less than 0.07 $\mu$m and the average grain size of the second non-image forming emulsion is greater than 0.1 $\mu$m.

12. The photographic element of claim 1 wherein the average grain size of the first non-image forming emulsion is less than 0.05 $\mu$m and the average grain size of the second non-image forming emulsion is greater than 0.1 $\mu$m.

13. The photographic element of claim 1 wherein the average grain size of the second non-image forming emulsion is at least twice the average grain size of the first non-image forming emulsion.

14. The element of claim 1 wherein the first non-image forming emulsion comprises at least 30 weight % and the second non-image forming emulsion comprises at least 10 weight % of the total non-image forming emulsion in the substantially non-image forming layer.

15. The element of claim 1 wherein the first non-image forming emulsion comprises at least 50 weight % and the second non-image forming emulsion comprises at least 10 weight % of the total non-image forming emulsion in the substantially non-image forming layer.

16. The photographic element of claim 1 wherein the imaging emulsion in the substantially non-image forming layer comprises tabular grain emulsions.

17. The photographic element of claim 1 wherein the mass of the imaging emulsion in the substantially non-image forming layer is less than 5 percent of the total mass of the imaging emulsions in the element.

18. The element of claim 1 wherein the substantially non-image forming layer is an intercoat layer.

19. The photographic element of claim 1 wherein the substantially non-image forming layer is an overcoat layer.

20. The photographic element of claim 19 wherein the layers between the support and the overcoat layer comprise red, blue and green color records.

21. The photographic element of claim 20 additionally comprising an oxidized developer scavenger layer between the overcoat layer and the color record furthest from the support.

22. The photographic element of claim 19 wherein the layers between the support and the overcoat layer comprise, in order, red, green and blue color records.

23. The photographic element of claim 22 wherein the overcoat layer is directly above the blue color record layer.

24. A reversal photographic element comprising a support and, coated on said support, at least one image recording emulsion layer comprised of a dispersing medium and radiation sensitive silver salt grains, and at least one substantially non-image forming layer comprising:

a) a light sensitive silver halide imaging emulsion which is less than 10 percent of the mass of the total imaging emulsion in the element; and b) a polydisperse non-image forming silver salt emulsion comprising iodide and having an average grain size less than 0.15 $\mu$m and a coefficient of variation of at least 50%;

wherein in the substantially non-image forming layer the surface area ratio of the grains of the non-image forming emulsion to the grains of the imaging emulsion is more than 2:1.

25. The element of claim 24 wherein the non-image forming emulsion comprise from about 1–15 mole % iodide.

26. A multicolor photographic element capable of forming a dye image comprising a support and, coated on said support, at least one image recording emulsion layer comprised of a dispersing medium and radiation sensitive silver halide grains, and at least one substantially non-image forming overcoat layer comprising:

a) a red light or green light or blue light sensitive silver halide imaging emulsion which is less than 10 percent of the mass of the total imaging emulsion in the element;

b) a first non-image forming silver salt emulsion having an average grain size less than 0.15 $\mu$m; and c) a second non-image forming silver salt emulsion comprising iodide having an average grain size greater than that of the first non-image forming emulsion;

wherein in the substantially non-image forming overcoat layer the surface area ratio of the grains of the non-image forming emulsions to the grains of the imaging emulsion is more than 2:1.

* * * * *